United States Patent [19]

Bauer et al.

[11] Patent Number: 4,979,729

[45] Date of Patent: Dec. 25, 1990

[54] SUCTION DEVICE FOR REMOVING FILM SHEETS

[75] Inventors: Walter Bauer, Munich; Johann Zanner, Unterhaching, both of Fed. Rep. of Germany

[73] Assignee: Agfa-Gevaert Aktiengesellschaft, Leverkusen, Fed. Rep. of Germany

[21] Appl. No.: 817,357

[22] Filed: Jan. 9, 1986

[30] Foreign Application Priority Data

Feb. 2, 1985 [DE] Fed. Rep. of Germany ..... 3503622

[51] Int. Cl.[5] ..... B65H 3/08

[52] U.S. Cl. ..... 271/106; 271/107; 294/64.1

[58] Field of Search ..... 271/106, 107, 132, 108, 271/90, 104, 105; 294/64.1

[56] References Cited

U.S. PATENT DOCUMENTS

| | | | |
|---|---|---|---|
| 783,206 | 2/1905 | Juengst | 271/106 |
| 1,448,690 | 3/1923 | Hetzer et al. | 294/64.1 |
| 2,850,279 | 9/1958 | Stoothoff et al. | 294/64.1 X |
| 3,154,306 | 10/1964 | Elliot et al. | 271/106 |
| 3,230,002 | 1/1966 | Olson | 294/64.1 |
| 3,272,549 | 9/1966 | Nisula | 271/90 X |
| 3,552,741 | 1/1971 | Staines | 271/106 X |
| 3,724,687 | 4/1973 | Marschke et al. | 271/90 X |
| 4,420,150 | 12/1983 | Umezawa | 271/106 X |
| 4,589,648 | 5/1986 | Hancock | 294/64.1 X |
| 4,591,140 | 5/1986 | Illig et al. | 271/107 X |

FOREIGN PATENT DOCUMENTS 2633831 1/1978 Fed. Rep. of Germany .

*Primary Examiner*—H. Grant Skaggs
*Assistant Examiner*—Steve Reiss
*Attorney, Agent, or Firm*—Michael J. Striker

[57] ABSTRACT

A device for the removal of sheet-like films from an X-ray film cassette or a film magazine by means of at least one sucker which has a suction lip with a frusto-conical inner surface by which a front edge of a film is lifted from the stack. The suction lip has at the inner surface in the proximity of the mouth of the suction conduit a flat projection extended towards the film being lifted but is spaced therefrom.

7 Claims, 2 Drawing Sheets

SUCTION DEVICE FOR REMOVING FILM SHEETS

BACKGROUND OF THE INVENTION

The present invention relates to a device for the removal of film sheets from a stack from an X-ray cassette or an X-ray film sheet magazine or the like by means of at least one sucker having a curved suction lip inner surface which lifts the front edge of the film sheet to lift the latter from the stack or from the rigid bottom wall of the film cassette.

A suction device of the type under discussion is disclosed, for example in DE-PS No. 2,633,831. The device includes a sucker for lifting bendable sheets. A bellows is connected to the sucker in the direction of a suction conduit, which bellows has small resistance to bending for the formation of the axis of bending in two diametrally opposing regions whereby the axis of bending extends traversely of the lifted sheet or staple edge. The lifted sheet is tilted in addition to the lifting motion so that the uppermost sheet is easily separated from the underlying sheet. However, an absolutely reliable separation of the uppermost sheet from the stack can not be obtained because the second uppermost sheet in the stack sticks to the first uppermost sheet and can be lifted therewith. The second uppermost sheet should be shaken off after the separation of the first uppermost sheet.

SUMMARY OF THE INVENTION

It is an object of the present invention to provide an improved suction device for removing film sheets from the stack.

It is another object of this invention to provide a suction device in which air would flow between the uppermost film sheet in the stack and the following film sheet, and the separation of the film from the following sheet or the rigid film sheet support would be accelerated so that a reliable separation would be obtained by simple means before the lifting of the following film sheet.

These and other objects of the present invention are attained by a device for the removal of at least one sheet of a film from an X-ray film cassette or an X-ray film magazine or the like, comprising at least one sucker having a suction lip with a curved inner surface applied to a film sheet near a front edge thereof for sucking the film sheet; and a suction conduit, said curved inner surface being substantially rotation-symmetrical and opening into said suction conduit, said suction conduit having a mouth, said inner surface having in the region of said mouth a projection deviating from the rotation-symmetrical surface said projection extending towards the film sheet but being spaced therefrom.

The inner surface of the suction lip may be substantially frustoconical.

The projection may be a substantially non-circular piece.

The largest dimension of said non-circular piece may be greater than the dimensions of its chords.

The projection may be a wedge-shaped piece which tapers in the direction of said front edge relative to a plane of the film sheet.

The mouth of the suction conduit may be non-symmetrical relative to said suction lip and offset away from said front edge.

The suction lip may have a recess at a side thereof facing away from said front edge.

Due to the suction device according to the invention a small arch-shaped camber or curve is produced on the film sheet within the suction lip of the sucker; the axis of this camber is normal to the front edge of the film sheet being sucked and to the axis of the suction conduit, this camber projecting up to the front edge of that film sheet. This arch-shaped camber also forms a channel in the direction normal to the film sheet front edge, through which air quickly flows into the space between the lifted uppermost film sheet and the next film sheet in the stack or the reinforcement foil or cassette bottom wall. This air breaks suction between the uppermost sheet and the following sheet so that a reliable and fast separation of the uppermost sheet from the following sheet before lifting of that sheet results.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
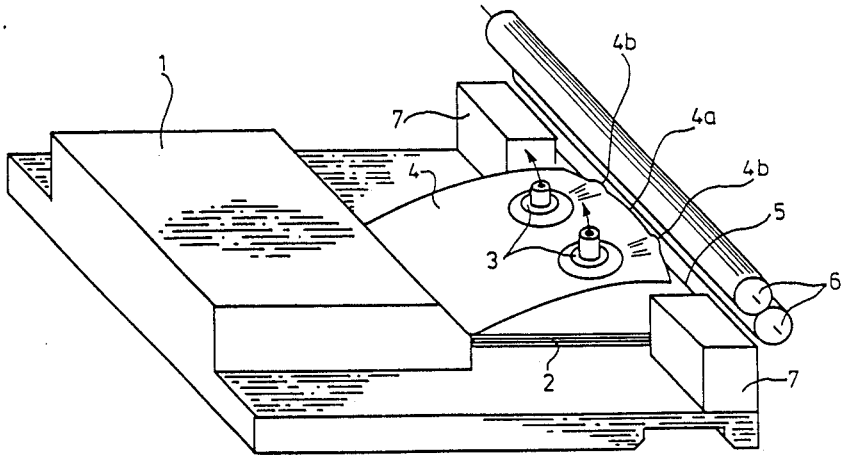
FIG. 1 is a simplified schematic perspective view of the device for the removal of film sheets according to the invention.

Referring now to the drawings in detail and firstly to FIG. 1 thereof, this figure illustrates a film supply cassette 1 which, for example is required in X-ray film cassette loading devices and contains a supply stack which is denoted by reference numeral 2. The uppermost film sheet in the stack is designated by reference numeral 4. The uppermost film sheet 4 is lifted from the remaining stack by two suckers 3 of a non-illustrated but conventional suction device. The film sheet 4 then approaches a stop strip 5 arranged before the sheet stack 2 and is moved in the transporting direction by transport rollers 6. The transport rollers 6 are positioned in the direction of transportation before the stop strip 5. Laterally of the stack 2 are positioned two limiting strips 7 which hold the stack 2 in alignment. Strips 7 are connected to stop strips 5. Suckers 3 firstly lift the uppermost film sheet 4 normally to the stack 2 so that this film sheet is raised over the stop strip 5 and then fed to the transport rollers 6. Reference numeral 8 denotes the bottom wall of the cassette.

Figure 5A:
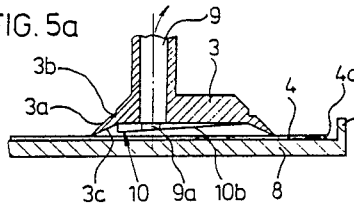
FIG. 5*a* is a sectional view taken along line V—V of FIG. 3, of the device in the position immediately before suction of a sheet of film.
Figure 5B:
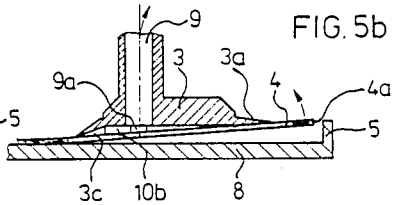
FIG. 5*b* is the sectional view of FIG. 5*a*, but in the position during the suction of a sheet of film.

Each sucker has a suction lip 3*a* the inner surface of each is rotation-symmetrical, preferably frustoconical. The suction lip 3*a*, at the highest region thereof, remote from the film, merges into a mouth 9*a* of a suction conduit 9. The suction lip 3*a* can have at least one ring-shaped groove 3*b* at the outer periphery thereof. A thinning can be provided at the outer periphery of the lip in place of groove 3*b* so that due to the groove or thinning a higher elasticity at the edge of the lip can be obtained, and the lifting and suction of the film sheet would be improved as clearly seen from FIG. 5*b*. The known suction device sucks the film sheet by suckers 3 in a dome-like fashion and approximately symmetrically relative to the axis of the mouth of the suction conduit 9*a*. The suckers should be also pivoted or tilted in order to shake off a sheet adhering to uppermost file sheet 4. In order to obtain these rotation or tilting motions of the suckers complicated mechanical control devices have been necessary which can be avoided due to the present invention.

Figure 2:
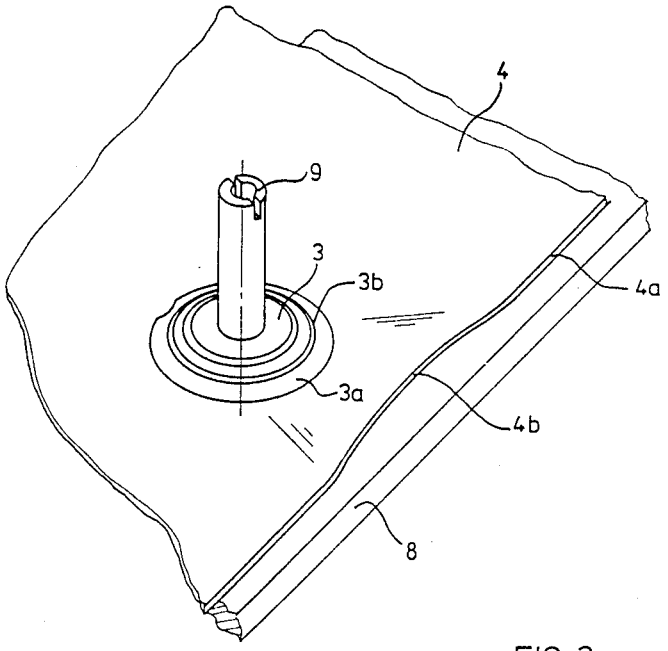
FIG. 2 is an enlarged view of the suction device shown in FIG. 1.
Figure 3:
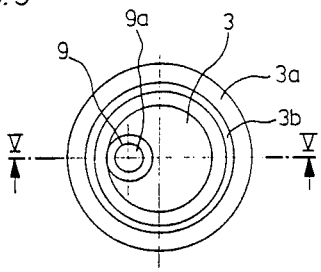
FIG. 3 is a plan top view of the suction element of the invention.

The inner surface 3*c* of the lip 3*a* has in the region thereof, lying near the suction conduit mouth 9*a*, a projection 10 which deviates from the frustoconical surface and extends towards the film front edge 4*a*. This projection 10 forms a hollow in the upward direction from the sheet being lifted. Thereby during the suction, the film surface below the sucker 3 is no longer dome-shaped but is curved more like an arch. These relatively small arch-shaped curves extend approximately up to the front edge 4*a* and are designated in FIGS. 1 and 2 by reference numeral 4*b*. Inasmuch as these curved sections are very limited the film sheet which lies below the uppermost sheet 4 splits off at this place so that air flows into a space between the lifted uppermost film sheet and the underlying film sheet or the underlying material, and a complete separation of the uppermost sheet 4 from the stack takes place. This process is very fast and is sufficient for a complete separation of the uppermost film sheet.

Figure 6:
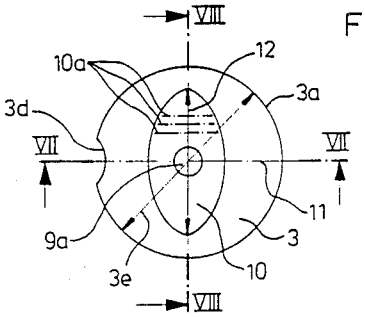
FIG. 6 is an underside view of the suction element of a further embodiment of the invention.
Figure 7:
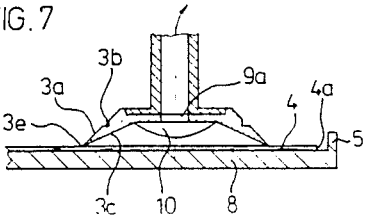
FIG. 7 is a sectional view taken along line VII—VII of FIG. 6.
Figure 8:
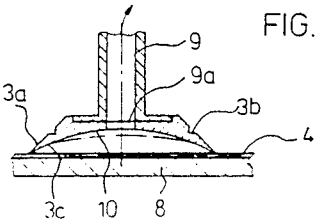
FIG. 8 is a sectional view taken along line VIII—VIII of FIG. 6.

In the embodiment illustrated in FIGS. 6 to 8 the piece 10 is formed as a non-circular inner piece on the suction lip inner surface 3*c*. The dimensions of chords 10*a* of this piece 10 are smaller than the largest diameter 3*e* of the suction lip 3. The chords 10*a* thus extend normally to the film front edge 4*a*. Thereby an arch-shaped or cylindrical curve or camber 4*b* corresponding to the shape of the piece 10 will be caused at the sucked film sheet 4, which camber will extend up to the front edge 4*a* of the film sheet so that air will enter between the lifted film 4 and the second uppermost sheet, whereby a complete separation from the stack would be obtained. It is sufficient that dimension 12 extended parallel to the film front edge 4*a* between the remotest points of the flattened piece 10 and projecting through the suction conduit mouth 9*a* be greater than the length of the chords 10*a*. The curve of the piece 10 has therefore a specifically good proportion for the formation of the camber 4*b*.

Figure 4:
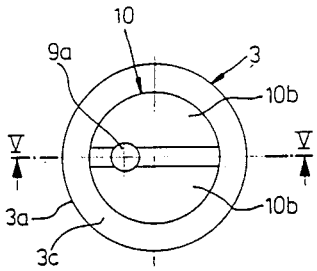
FIG. 4 is a plan view of the underside of the suction element of FIG. 3.

FIGS. 3, 4, 5*a* and 5*b* illustrate another embodiment of the invention in which the piece or projection 10 provided on the underside of suction lip 3 has two wedge-shaped portions or strips extended at two opposite sides of the mouth of suction conduit 9*a* as seen from FIG. 4. The cross-section of each wedge-shaped portion 10*b* tapers towards the front edge 4*a* of the film being sucked. Sheet 4 sucked by suckers 3 is lifted into a deep channel formed between two wedge-shaped portions 10*b* but below suction lip 3*a*. The arch shaped or conical curve or camber 4*b* of the film sheet 4 would result with the axis of the curve being perpendicular to the front edge 4*a*. The operation in this embodiment is substantially the same as that described for FIGS. 6–8. The suction conduit mouth 9*a* in this embodiment is non-symmetrical relative to the suction lip 3*a* and is offset rearwardly from the front edge 4*a*. The separation of the suckers from the rigid bottom wall, for example 8 supporting the stack can be thus facilitated.

The suction device for separating film sheets from the stack according to the present invention can be advantageously utilized for example in film sheet supply magazines. This suction device can be also employed for the removal of an individual film from the film cassette because the film, stuck to a reinforcement foil or a cassette wall, can be easily separated. It can be sufficient that the edge of the suction lip would have a small recess 3*d* at the place not immediately adjacent to the film edge 4*a*. This recess would also facilitate the separation of the sucker 3 when the latter should be sucked away not from the film sheet but rather from the empty cassette or empty magazine or bottom wall 8. The recess 3*a* is positioned sufficiently far not to interfere with the suction action; however, air can flow upon an insignificant lifting of the sucker at this recess so that the sucker would be separated from the rigid bottom wall 8.

It will be understood that each of the elements described above, or two or more together, may also find a useful application in other types of suction devices for the removal of film sheets differing from the types described above.

While the invention has been illustrated and described as embodied in a suction device for the removal of film sheets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A device for the removal of at least one sheet of a film from an X-ray film cassette or an X-ray film magazine or the like, comprising at least one sucker, the film sheet being removed having a front edge, as viewed in the direction of removal of the film sheet, said sucker being applied to said front edge of said sheet and having a suction lip with a curved inner surface which faces said sheet near said front edge thereof; and a suction conduit having a mouth which opens into said curved inner surface, said inner surface being substantially rotation-symmetrical and having an axis which is offset from said mouth, said inner surface having in the region of said mouth a projection deviating from the rotation-symmetrical surface so that a non-rotationally-symmetrical suction lip is formed, said projection extending outwardly from said inner surface towards said sheet being sucked and being formed of two wedge-shaped portions positioned at two sides of said mouth and each tapering in the direction towards said front edge.

2. The device as defined in claim 1, wherein said inner surface is substantially frustoconical.

3. The device as defined in claim 1, wherein said mouth of the suction conduit is non-symmetrical relative to said suction lip and is offset from said front edge.

4. The device as defined in claim 1, wherein said lip has an external surface provided with a ring-shaped groove.

5. A device for the removal of at least one sheet of a film from an X-ray film cassette or an X-ray film magazine or the like, comprising at least one sucker, the film sheet being removed having a front edge, as viewed in the direction of removal of the film sheet, said sucker being applied to said front edge and having a suction lip with a curved inner surface which faces said sheet near said front edge thereof; and a suction conduit having a mouth which opens into said curved inner surface, said inner surface being substantially rotation-symmetrical, said inner surface having in the region of said mouth a projection deviating from the rotation-symmetrical surface so that a non-rotationally-symmetrical suction lip is formed, said projection extending outwardly from said inner surface towards the film being sucked and being substantially elliptical.

6. The device as defined in claim 5, wherein said inner surface is substantially frustoconical.

7. The device as defined in claim 5, wherein said lip has an external surface provided with a ring-shaped groove.

* * * * *